US007334953B2

(12) United States Patent
Chu

(10) Patent No.: US 7,334,953 B2
(45) Date of Patent: Feb. 26, 2008

(54) CARD PRINTER

(75) Inventor: Kai-Min Chu, Taipei (TW)

(73) Assignee: HiTi Digital, Inc., Taipei (TW)

( * ) Notice: Subject to any disclaimer, the term of this patent is extended or adjusted under 35 U.S.C. 154(b) by 143 days.

(21) Appl. No.: 11/162,529

(22) Filed: Sep. 14, 2005

(65) Prior Publication Data

US 2007/0009304 A1 Jan. 11, 2007

(30) Foreign Application Priority Data

Jul. 11, 2005 (TW) ..... 94123404 A

(51) Int. Cl.
*B41J 29/00* (2006.01)

(52) U.S. Cl. ..... 400/521; 400/693

(58) Field of Classification Search ..... 400/521
See application file for complete search history.

(56) References Cited

U.S. PATENT DOCUMENTS 4,715,735 A * 12/1987 Kuzuya et al. ..... 400/82
4,783,681 A * 11/1988 Tanaka et al. ..... 399/13
5,784,077 A * 7/1998 Silverbrook ..... 347/2
6,238,115 B1 * 5/2001 Silverbrook et al. ..... 400/693
6,318,840 B1 * 11/2001 Sette et al. ..... 347/37
6,588,877 B2 * 7/2003 Sloan et al. ..... 347/40

FOREIGN PATENT DOCUMENTS

JP 04371877 A * 12/1992

* cited by examiner

*Primary Examiner*—Daniel J. Colilla
(74) *Attorney, Agent, or Firm*—Winston Hsu

(57) ABSTRACT

A card printer includes a housing, a card inlet and a card outlet. A distance between the card inlet and the bottom of the housing is approximately the same as a distance between the card outlet and the bottom of the housing. When serially connecting two similar card printers, the card outlet of the first printer is positioned corresponding to the card inlet of the second printer. Therefore, a card outputted from the card outlet of the first printer is directly inputted into the card inlet of the second printer thereby simplifying a card printing process and reducing labor.

3 Claims, 4 Drawing Sheets

CARD PRINTER

BACKGROUND OF THE INVENTION

1. Field of the Invention

The present invention relates to a card printer, and more particularly, to a card printer having a height of a card inlet and a height of a card outlet that are approximately the same.

2. Description of the Prior Art

There are different types of printers, some for printing documents and some for printing photos or cards. Generally, there are two printing methods implemented in a card printer. One is dye sublimation and the other is hot stamping. Take dye sublimation for example. This technique utilizes a solid ribbon to transfer colors, in an overlapping manner, onto a card for printing patterns. The ribbon typically includes four sections, yellow, magenta, cyan, and overcoating (YMCO). When printing, a thermal print head heats colored dyes on the ribbon, and due to the temperature change, the color dye is temporarily liquefied and is transferred onto the card. Then, the color dyes are cooled and thus fixed on the card to impart a colorful pattern.

In addition to color printing, hot stamping is also used for printing patterns or letters. The ribbon for hot stamping is different from a YMCO ribbon. And card printers only can have one type of ribbon installed at a time. If both color printing and hot stamping are required, two card printers are needed, one for color printing and another for hot stamping. When the first card printer completes color printing, an operator must deliver cards output from the first card printer to the second card printer for hot stamping. It is really inconvenient, wastes time, and consumes labor.

SUMMARY OF THE INVENTION

It is therefore a primary objective of the claimed invention to provide a card printer having a height of a card inlet and a height of a card outlet that are approximately the same to solve the above-mentioned problem.

The claimed invention discloses a card printer comprising a housing, a card inlet formed on the housing, and a card outlet formed on the housing. A distance between the card inlet and the bottom of the housing is approximately the same as a distance between the card outlet and the bottom of the housing.

These and other objectives of the present invention will no doubt become obvious to those of ordinary skill in the art after reading the following detailed description of the preferred embodiment that is illustrated in the various figures and drawings.

DETAILED DESCRIPTION

In order to solve the problem mentioned above, the present invention provides a structure of a card printer that provides an easy way for color printing and hot stamping.

Figure 1:
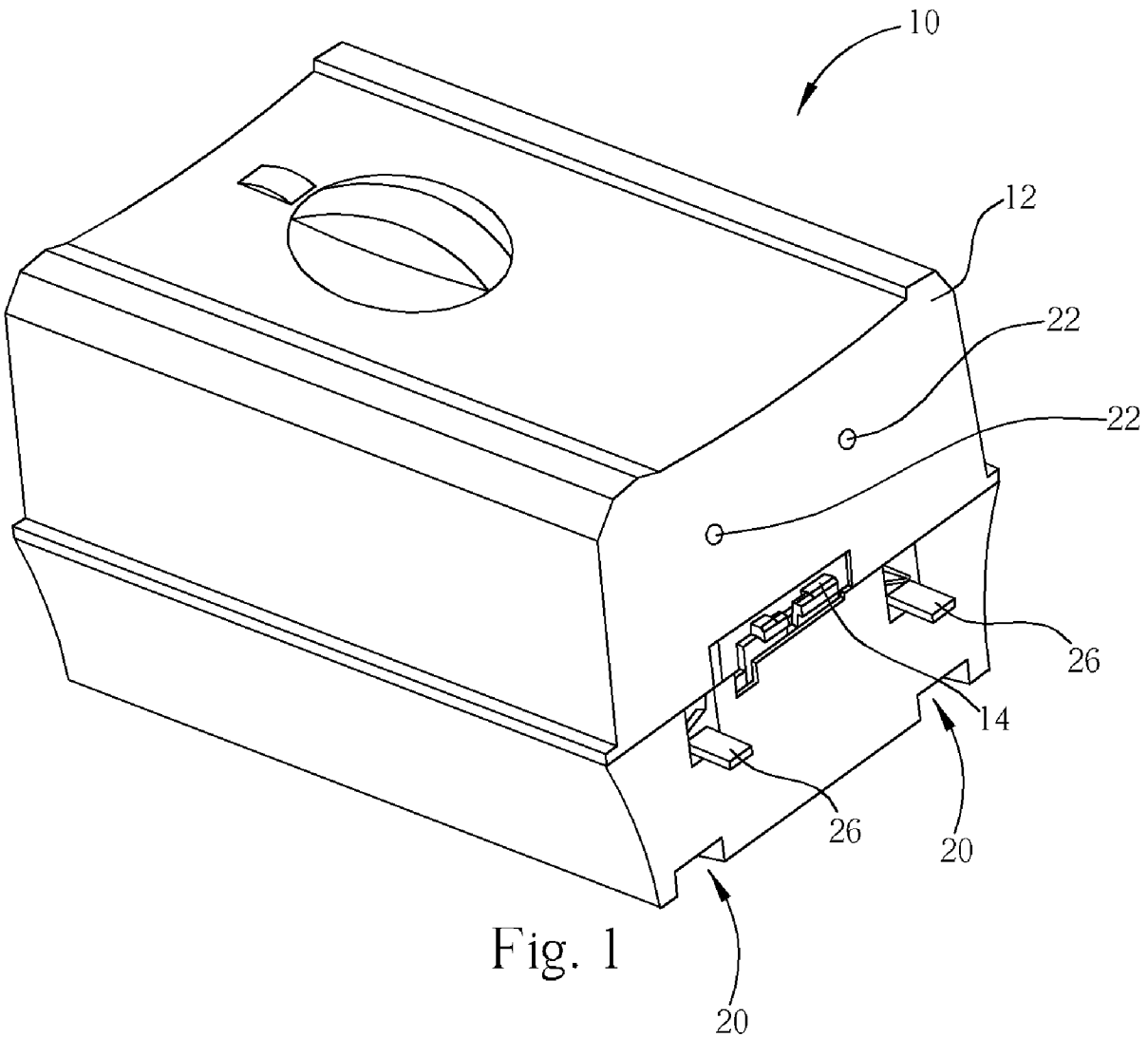
FIGS. 1 and 2 respectively show an input and an output of a card printer 10 according to the present invention.
Figure 2:
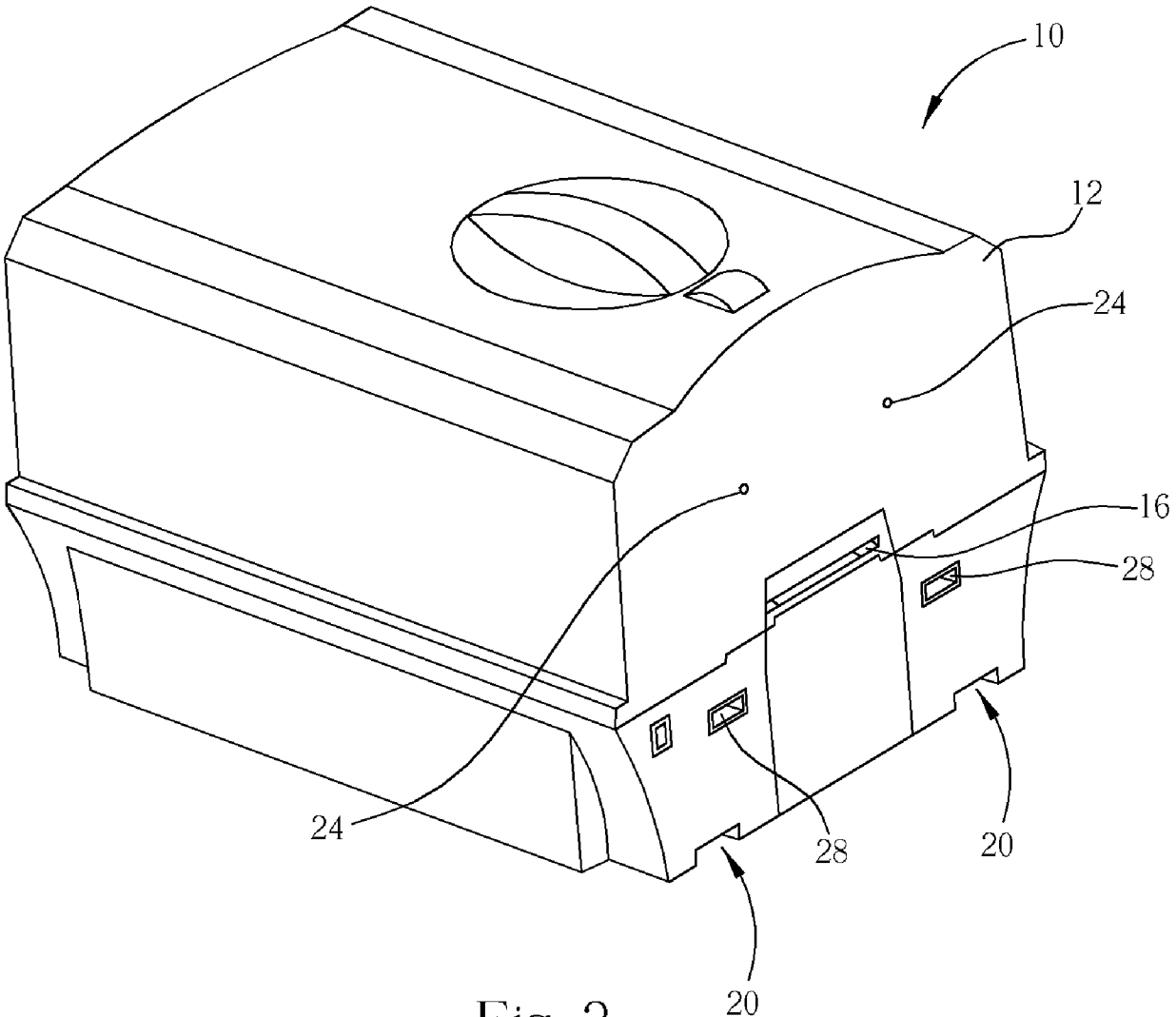

Please refer to FIGS. 1 and 2, which respectively show an input and an output of a card printer 10 according to the present invention. As shown in FIG. 1, the housing 12 of the card printer 10 comprises a card inlet 14 for receiving cards. The housing 12 further comprises two connecting holes 22 for accommodating a screw, and two engaging elements 26. Two tracks are formed on the bottom of the housing 12 for accommodating a connecting rod (e.g. an aluminum rod) to serially connect two card printers 10.

In FIG. 2, the output of the card printer 10 comprises a card outlet 16 for outputting printed cards. A distance between the card outlet 16 of FIG. 2 and the bottom of the housing 12 is approximately the same as a distance between the card inlet 14 of FIG. 1 and the bottom of the housing 12. When two card printers 10 are serially connected, the card outlet 16 of the first card printer 10 is positioned corresponding to the card inlet 14 of the second card printer 10, so that a card output from the card outlet 16 of the first card printer 10 can be sent into the card inlet 14 of the second card printer 10 for the next printing process.

The input of the card printer 10 in FIG. 2 further comprises two connecting holes 24 and two engaging holes 28. When a screw passes through the connecting holes 22 of FIG. 1 and the connecting holes 24 of FIG. 2, two card printers 10 can be serially connected. Or the engaging elements 26 of FIG. 1 can be inserted into the engaging hole 28 of FIG. 2 for serially connecting two card printers 10. Moreover, an aluminum rod can be placed inside the tracks 20 of both card printers 10 to achieve the connection.

Figure 3:
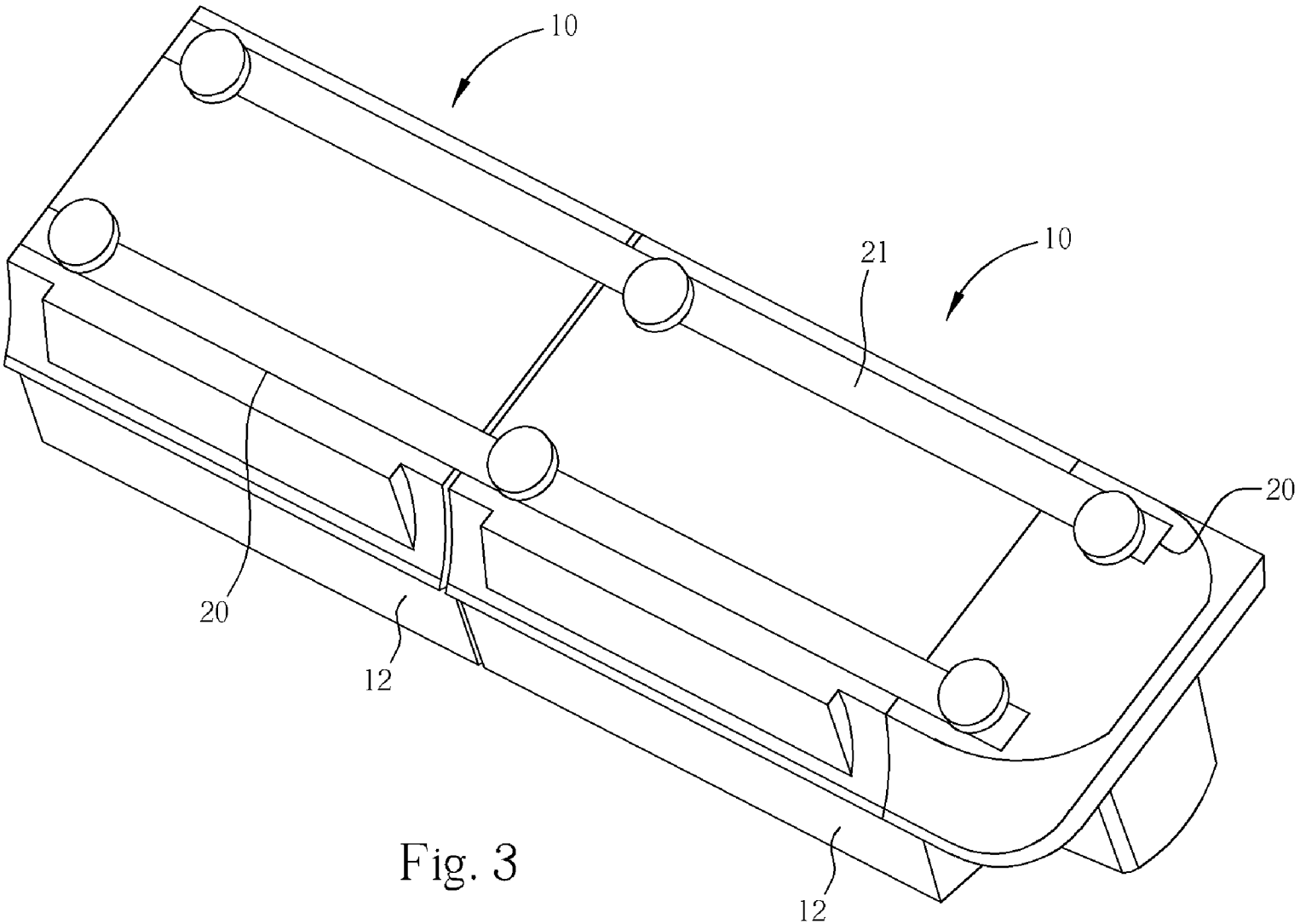
FIGS. 3 and 4 are diagrams of serially connecting two card printers according to the present invention.
Figure 4:
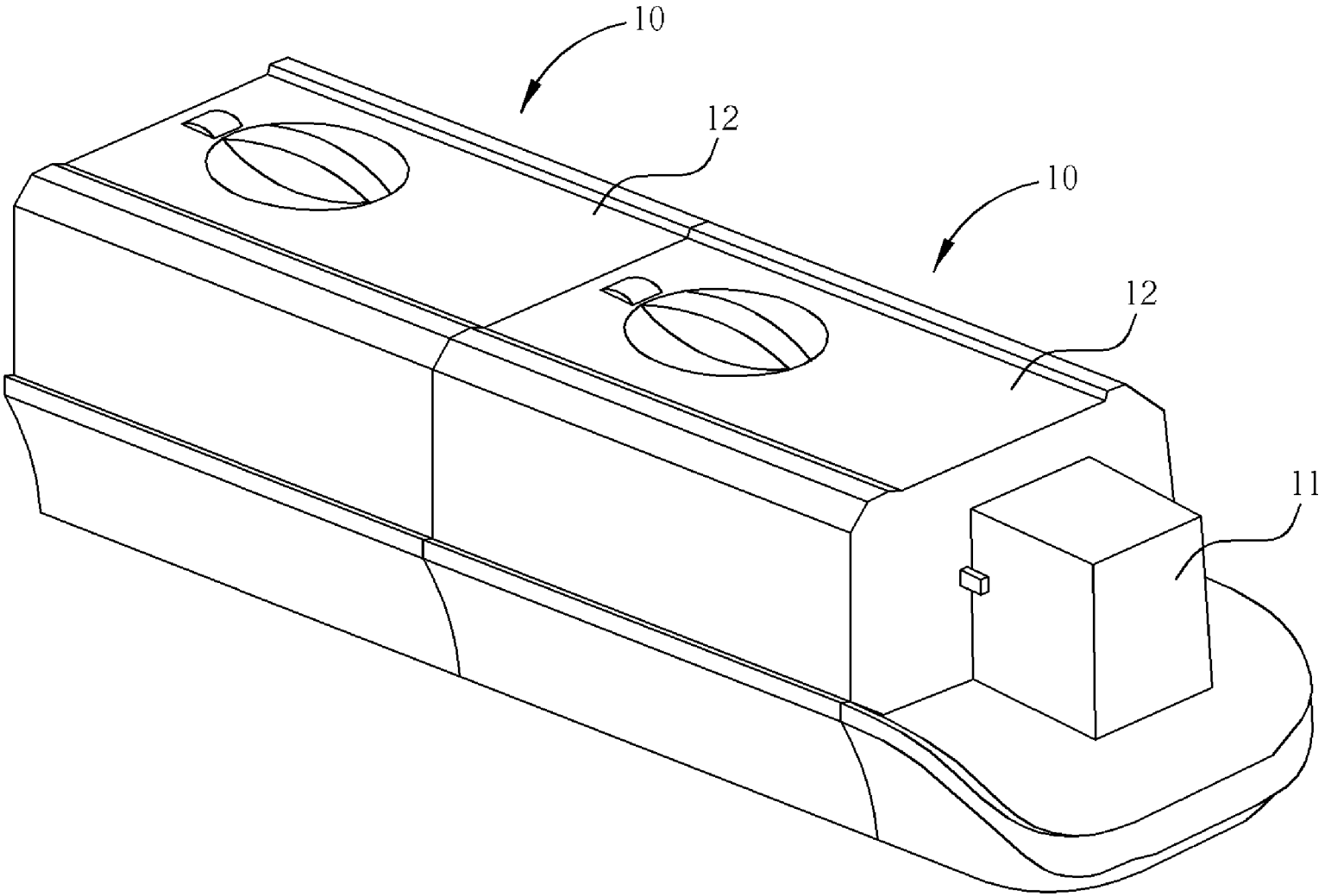

Please refer to FIGS. 3 and 4. FIG. 3 shows a diagram of using aluminum rods 21 for serially connecting two card printers 10. FIG. 4 is a diagram of a connection of two card printers 10. As shown in FIG. 4, there is a card feeder 11 accommodating unprinted cards. After two card printers 10 are serially connected, cards can be continuously printed for color printing and hot stamping respectively in each card printer 10.

Therefore, with the structure of the card printer of the present invention, two card printers can be easily serially connected. If hot stamping and color printing are both required, cards can be continuously printed and automatically transmitted from a card printer to another card printer. Thus, no operator has to take cards from one card printer to another one, thereby reducing labor and simplifying a card printing process. Additionally, the card printer of the present invention can operate independently, having all the functions of a general card printer.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A card printer system, comprising:

a plurality of card printers, each card printer comprising:

a housing;

a card inlet formed on a first side of the housing;

a card outlet formed on a second side of the housing opposite the first side of the housing, wherein a distance between the card inlet and the bottom of the housing is approximately the same as a distance between the card outlet and the bottom of the housing; and a track formed on the bottom of the housing; and a connecting rod installed in the tracks of the plurality of card printers for joining the card printers together, wherein when two card printers are connected serially with the first side of one card printer placed adjacent to the second side of another card printer, the tracks of the card printers align for accommodating the connecting rod that extends the entire length of both tracks of the card printers.

2. The card printer system of claim 1, wherein each card printer further comprises a connecting hole formed on the first side of the housing and another connecting hole formed on the second side of the housing, wherein when two card printers are placed adjacent to each other, a screw is placed through the connecting holes for connecting the two card printers.

3. The card printer system of claim 1, wherein each card printer further comprises an engaging element positioned on the housing and separate from the card inlet and card outlet, the engaging element for engaging with an engaging element of another card printer.

* * * * *